United States Patent [19]

Knoebl

[11] Patent Number: 4,461,128

[45] Date of Patent: Jul. 24, 1984

[54] SOFFIT AND FASCIA CONSTRUCTION

[76] Inventor: Emmerich Knoebl, 22 W. 421 Army Trail, Addison, Ill. 60101

[21] Appl. No.: 281,488

[22] Filed: Jul. 8, 1981

[51] Int. Cl.[3] ..... E04D 13/15; E04B 1/00

[52] U.S. Cl. ..... 52/94; 52/747

[58] Field of Search ..... 52/94, 96, 282, 288, 52/287, 741, 747

[56] References Cited

U.S. PATENT DOCUMENTS

| | | | |
|---|---|---|---|
| 1,942,137 | 1/1934 | Connell et al. | 52/287 |
| 3,415,019 | 12/1968 | Andersen | 52/288 |
| 3,918,228 | 11/1975 | La Borde | 52/288 |
| 4,037,372 | 7/1977 | Patry | 52/96 |
| 4,189,885 | 2/1980 | Fritz | 52/282 |

*Primary Examiner*—John E. Murtagh
*Assistant Examiner*—Michael Safavi
*Attorney, Agent, or Firm*—Dressler, Goldsmith, Shore, Sutker & Milnamow, Ltd.

[57] ABSTRACT

An improved construction and method of assembly for applying vinyl soffit and fascia panels to a cornice of a structure precludes the usual time-consuming process of installing the soffit panels one at a time by sliding them through supporting channel or by flexing the panels. The construction includes an improved corner member having outer and lower legs which is fitted adjacent to the bottom of the fascia of the cornice. The corner member includes a lock leg depending from one of the outer and lower legs, and is adapted to engage outer edge portions of the soffit panels and a lower edge portion of the fascia panel whereby the installation of the soffit panels may be accomplished in an efficient and straightforward fashion.

17 Claims, 8 Drawing Figures

FIG. 1
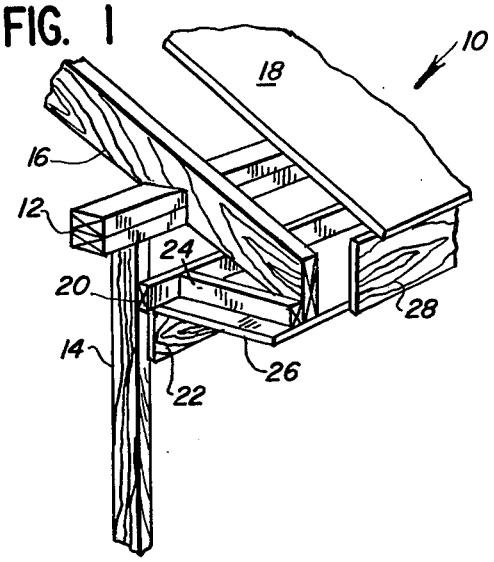
FIG. 2 PRIOR ART
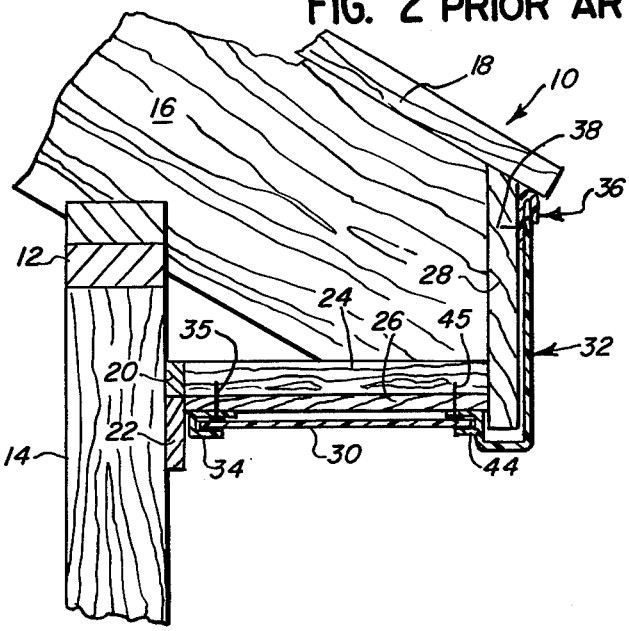
FIG. 3
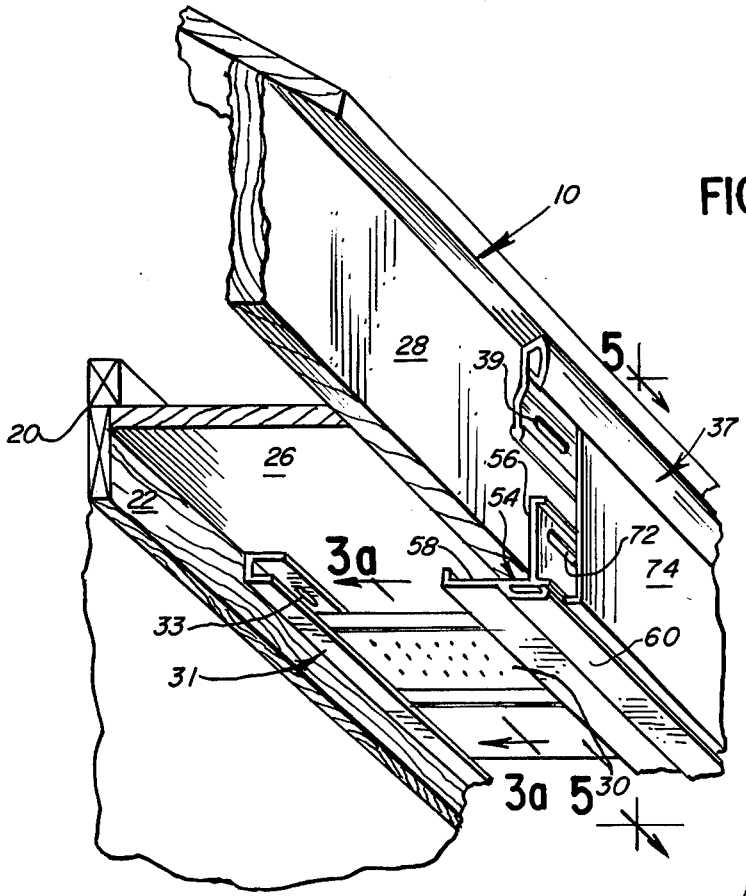
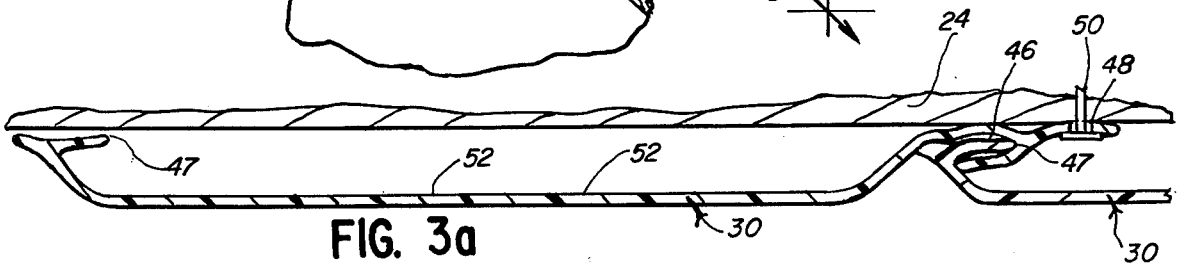
FIG. 3a

FIG. 4
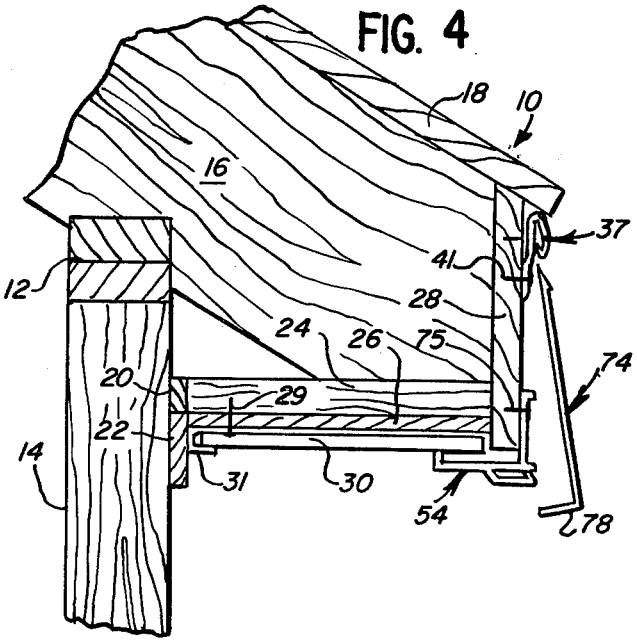
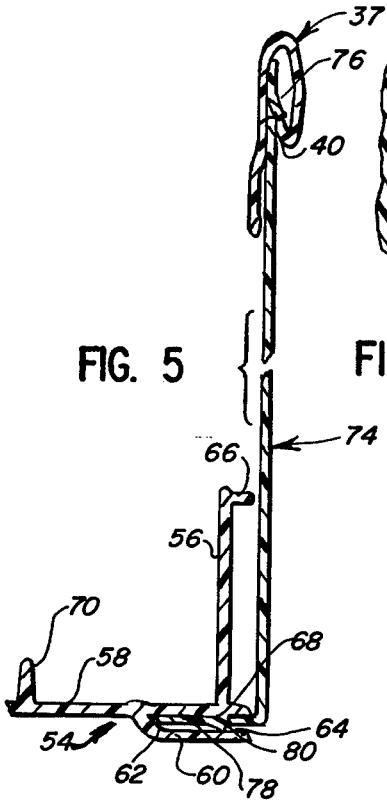
FIG. 5
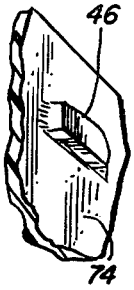
FIG. 5a
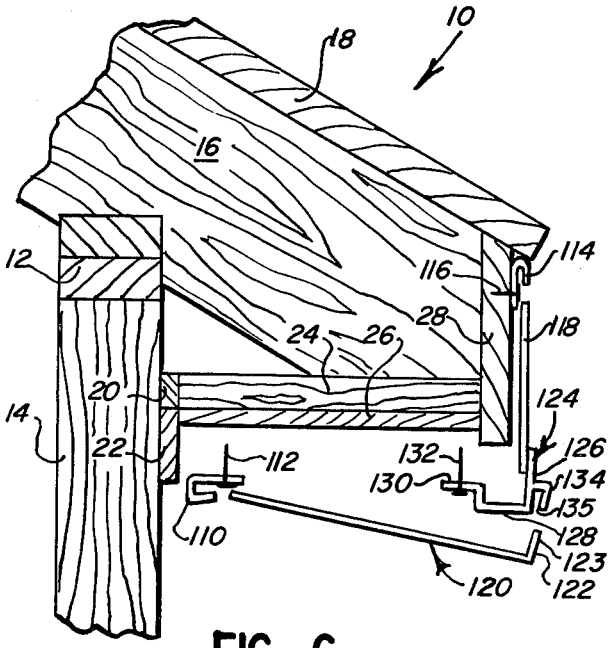
FIG. 6
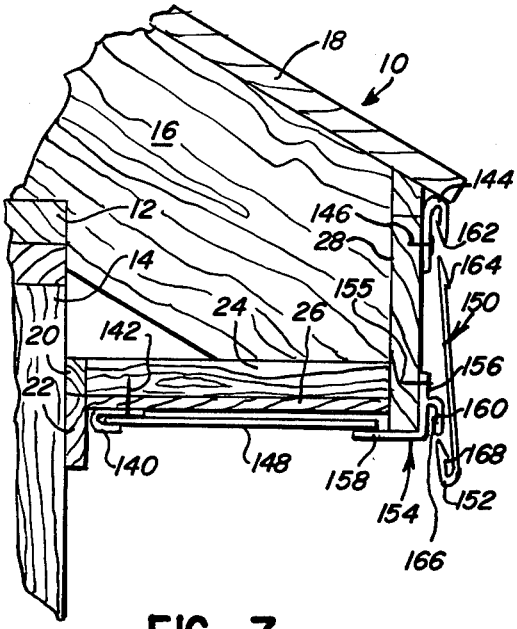
FIG. 7

SOFFIT AND FASCIA CONSTRUCTION

TECHNICAL FIELD

This invention relates generally to building materials and methods of construction, and more particularly to a method and arrangement for applying soffit and fascia siding panels to the cornice of a structure.

BACKGROUND OF THE INVENTION

The use of vinyl siding materials has found widespread acceptance in the building industry, particularly in residential construction. These materials are particularly suitable for both recovering of an existing structure, as well as for covering the outside surfaces of new construction. Among the advantages of use of vinyl siding are its light weight and durability. The vinyl panels are impregnated with color when manufactured (usually by extrusion), and resist denting, scratching, and peeling. Siding panels of this nature are easy to work with, and provide an extremely attractive appearance when finished. Panels of this type are available in a variety of colors, and suitable extruded accessory pieces such as channels, corner posts, starter strips and cover trim are available for enhancing the ease of installation and the appearance of the finished structure.

Heretofore, use of vinyl soffit and fascia panels for covering and forming a boxed cornice of a structure has presented several problems. Because the nails and nailing slots which are used to install the panels and trim should be covered when installation is complete for the best appearance, specially fabricated vinyl pieces have usually been installed in a time consuming fashion so that all nails used for affixing the pieces to the cornice are covered when the job is finished. The typical arrangement includes at least one fascia panel for covering the outwardly facing fascia of the cornice, and soffit panels which are fitted beneath the cornice, and which may be affixed to an existing soffit depending upon the construction of the cornice.

In order to install these panels to provide a properly finished appearance, an elongated, J-shaped channel adapted to receive the inner edges of the soffit panels is first affixed beneath the cornice adjacent to the wall of the structure. This channel includes elongated nailing slots through which corrosion resistant nails are inserted for affixing the channel to the cornice. An elongated piece of cover trim, generally J-shaped in cross-section, is then affixed to the upper portion of the fascia of the cornice. Similarly, the cover trim is affixed to the fascia with nails inserted through elongated slots therein. The cover trim is typically of a configuration such that upper edges of fascia panels inserted within the trim are lockingly engaged thereby.

The next step in installation includes the application of a channel along the bottom of the fascia which is adapted to receive outer edge portions of the soffit panels. This corner channel may typically be of a J-shape or F-shape configuration, and includes an elongated portion adapted to be affixed to the cornice with nails. Frequently, this corner channel is formed integrally with the fascia panel, which includes along its upper edge portion locking lugs which are adapted to lockingly fit within the cover trim affixed along the top of the fascia. Other arrangements may include a separate fascia panel which fits about the corner channel and then may be locked to the cornice by fitting its upper edge portion within the cover trim so that it is lockingly retained therein.

With all of these types of installations, the lower surface of the cornice is provided with a channel disposed beneath the cornice adjacent to the wall of the structure, and a channel disposed along the bottom of the fascia, with the installation of the soffit panels being the next step in covering the cornice. It is this step in the installation which has proved to be the most time consuming and labor intensive. The reason for this is that each of the soffit panels includes edge portions which are adapted to interlock with the soffit panels adjacent thereto. Typically, these interlocking edge portions include an inwardly disposed lock lip along one edge, which is adapted to fit within a lock groove provided on the edge portion of the adjacent soffit panel. The edge portion of each soffit panel which includes the lock groove may typically include nailing slots so that each of the soffit panels may be affixed to the cornice.

Installation of the soffit panels has customarily entailed slipping each of the soffit panels into the respective channels provided on the bottom of the cornice from the ends of these channels. Each soffit plate is then slid through the channels into position, and its lock lip fitted and nested within the lock groove of a previously installed soffit panel. Each of the soffit panels is then affixed to the cornice by inserting nails through the nailing slots provided in the edge portion of the panel, and the procedure is then repeated for the installation of each of the soffit panels.

The result of this procedure is the covering of the cornice with vinyl siding with an attractive and professional looking finish. However, as is readily apparent, the necessity of inserting each of the soffit panels one at a time, sliding them through the respective channels beneath the cornice, interlocking them and nailing them to the cornice, and then repeating the procedure for the next soffit panel has proven to be quite labor intensive. Further, this procedure may prove to be very difficult for even the most straightforward applications since the person installing the panels would almost always be standing on a ladder or scaffolding while finishing this portion of the structure.

In some applications, insertion of the soffit panels within the channels provided along the bottom of the cornice may be attempted by bending or flexing the soffit panels and then fitting each one within the respective channels. However, this procedure may be no more simple than the procedure described above. Because each of the soffit panels usually includes edge portions which define lock lips and grooves, each of the panels exhibits a substantial degree of rigidity when attempting to bend or flex it perpendicularly of these lips and lock grooves. Further, depending upon the exact nature of the application involved, each of the soffit plates may be relatively narrow, thus making flexing of each panel an amount sufficient to fit the panel within the channels practically impossible.

Thus, a person applying the soffit panels to a cornice which would require relatively narrow panels would have no choice but to insert each of the soffit panels from the end of the respective channels, slide each through the channels into position, interlock and affix each panel in place, and then repeat the procedure, all at great time and effort.

An arrangement and method for installation of vinyl fascia and soffit panels to the cornice of the structure which would preclude the necessity of fitting the panels as described above would result in a tremendous savings of labor and installation time, thus further enhancing the desirability of the use of vinyl siding materials.

SUMMARY OF THE INVENTION

The subject invention provides a novel method and arrangement for the application of vinyl siding materials to the cornice of the structure, the use of which provides a significant savings in labor in that the installation of the soffit panels to the cornice no longer requires either of the above-described labor intensive procedures.

In the preferred embodiment of the invention, a generally J-shaped inner channel for receiving inner edges of soffit panels is provided along the bottom of the cornice adjacent to the wall of the structure, and affixed thereto. Suitable cover trim for lockingly retaining upper edges of fascia panels is affixed along the top of the fascia of the cornice. The subject invention now permits the installation of the soffit panels beneath the cornice for fitment within the channel provided along the wall of the structure. A person installing the soffit panels may do so in an extremely efficient and straightforward fashion by merely inserting the inner edge of each of the panels within the inner channel and interlocking the panel with a previously installed adjacent panel. The panel is then affixed to the cornice by nailing through the nailing slots provided therein. This procedure is repeated until all of the soffit panels are in place beneath the cornice. It will be appreciated that installing soffit panels in this way is significantly less time consuming than the methods previously used.

When all of the soffit panels are in place, the subject invention provides the application of a novel elongated corner member which is affixed to the cornice along the lower edge of the fascia. In the preferred embodiment, the corner member includes a generally vertically disposed outer leg and a lower leg formed integrally with the outer leg and which extends inwardly of the cornice from a bottom portion of the outer leg. The lower leg includes an upstanding spacing lug along its inner edge which abuts and fits against the lower surface of each of the soffit panels after the corner member is affixed to the fascia of the cornice, thereby providing the lower surface of the cornice with a finished appearance.

The corner member further includes a lock leg which depends from the lower surface of the lower leg intermediate an inner edge thereof and the bottom of the outer leg. The lock leg and lower leg define an outwardly opening lock slot.

The outer fascia panel of the siding arrangement may now be applied to the cornice. This panel is generally L-shaped in cross-section, and includes along its upper edge lock lugs which are adapted to lockingly fit within the cover trim extending along the top of the fascia of the cornice. The bottom portion of the fascia panel includes an inwardly extending portion which is provided with suitable lock lugs which are adapted to be lockingly retained within the lock slot defined by the lock leg and lower leg of the corner member.

Thus, application of the fascia panel to the cornice is a simple matter of merely inserting the upper edge of the fascia panel within the cover trim such that the panel is lockingly retained therein, and then pressing the lower portion of the panel such that the inwardly extending lower lock portion thereof is inserted and fits within or snaps into the lock slot defined by the corner member. The application of vinyl siding to the cornice member of the structure is now complete, and presents an attractive appearance with all nailing slots and nails covered by associated pieces of the construction. This construction is applied in an efficient and straightforward manner which precludes the problematic insertion of soffit panels in the fashion described above, and which can reduce application time by as much as 50%.

Alternate embodiments of the subject invention provide similarly efficient methods of covering the cornice of the structure with vinyl siding. In each of the alternate embodiments, an elongated generally J-shaped inner channel is affixed beneath the cornice adjacent the wall of the structure. A length of cover trim is then affixed to the cornice along the top of the fascia.

In one alternate embodiment, the fascia panel is then inserted or snapped into the cover trim and retained therein by a lock tab engaging lock lugs punched into the top of the fascia panel. A corner member is then affixed along the bottom of the fascia and includes a lower leg, and an outer leg which overlaps and engages the bottom of the fascia panel. The corner portion includes a lock leg which depends from the outer leg of the corner member and defines a downwardly opening lock slot therewith. Suitable soffit panels are then affixed to the cornice by fitting their inner edges into the channel disposed adjacent to the wall of the structure. The outer edges of the soffit plates include an upstanding angle provided with lock lugs which then may be easily inserted in the lock slot defined by the corner member; thus providing a finished siding structure for the cornice in which none of the nails used for attaching the pieces are exposed.

In another embodiment of the invention, inner edges of soffit panels are fitted within the channel disposed along the wall of the structure, and a corner member is affixed to the bottom of the fascia such that an inwardly extending lower leg of the corner member overlaps and supports outer edges of the soffit panels. The corner member is affixed to the fascia by nails inserted through an upwardly extending outer leg thereof, from which a lock leg depends and defines with the outer leg a downwardly opening lock slot. A fascia panel having a generally J-shaped configuration in cross-section may now be inserted within the upper cover trim and the lock slot of the corner member, and retained therein by suitable lock lugs punched into the edges of the fascia panel.

In each of the above-described arrangements, the cornice of the structure is provided with fitted vinyl siding wherein all of the attachment nails and nailing slots are covered for the desired finished appearance, with each embodiment avoiding the need to insert the soffit plates in the usual time consuming fashion.

Thus, it will be appreciated that the subject invention provides a simple and straightforward method and construction for applying vinyl soffit and fascia panels to the cornice of a structure, and avoids application procedures which heretofore have proven to be both time consuming and difficult.

BRIEF DESCRIPTION OF THE DRAWINGS

FIG. 1 is a perspective cut-away view of a structure illustrating the elements of a typical cornice construction;

FIG. 2 is a cross-sectional view of the cornice illustrated in FIG. 1 to which conventional fascia and soffit panels have been applied;

FIG. 3 is a cut-away perspective view of the cornice shown in FIG. 1 illustrating one embodiment of the arrangement of the soffit and fascia siding construction of the subject invention;

FIG. 3*a* is a cross-sectional view taken along line 3*a*—3*a* in FIG. 3 showing the configuration of typical vinyl soffit panels;

FIG. 4 is a cross-sectional view similar to FIG. 2 showing the assembly of the subject soffit and fascia panel construction;

FIG. 5 is an enlarged cross-sectional view of elements of the subject soffit and fascia siding construction;

FIG. 5*a* is a perspective view of a vinyl siding panel illustrating a typical lock lug punched therein;

FIG. 6 is a cross-sectional view similar to FIG. 2 showing the construction and assembly of an alternate embodiment of the subject soffit and fascia siding construction; and FIG. 7 is a cross-sectional view similar to FIG. 2 showing the assembly and construction of a further embodiment of the subject soffit and fascia siding construction.

DESCRIPTION OF THE PREFERRED EMBODIMENT

While the subject invention is susceptible of embodiment in different forms, there is shown in the drawings and will hereinafter be described a preferred embodiment and two alternate embodiments with the understanding that the present disclosure is to be considered as an exemplification of the principles of the invention and is not intended to limit the invention to the embodiments illustrated.

Referring now to FIG. 1, therein is shown a cut-away of the typical construction of a cornice 10 of a structure. This type of an arrangement is sometimes referred to as a boxed cornice, and is frequently found on a wide variety of structures, particularly residences. However, it will be understood that the subject invention would be equally applicable to a wide variety of cornice arrangements, and the cornice 10 shown in FIG. 1 is merely for purposes of illustration.

This construction includes a horizontally extending wall plate 12 which is supported atop a plurality of laterally spaced wall studs 14 (one being shown). The roof structure which defines the upper surface of the cornice includes laterally spaced rafters 16 (one being shown) to which roof sheathing 18 is attached. The roof sheathing 18 is typically covered with shingles or other suitable roofing material.

The construction of the cornice 10 may further include horizontally disposed nailing block 20, and the wall of the structure may include a frieze board 22. The lower surface of the cornice 10 is defined by laterally spaced lookouts 24 (one being shown) which project outwardly from the nailing block 20. A soffit 26 (sometimes referred to as a plancier) is affixed to the lookouts 24, and extends between the frieze board 22 and the outer edge of the cornice 10.

The outwardly facing surface of the cornice is defined by a fascia 28 which is typically disposed below the roof sheathing 18 and is affixed in abutting relation to the end of the rafters 16, the lookouts 24, and the outer edge of the soffit 26.

When installing vinyl siding to the cornice 10 as described, certain of the above-described elements may or may not be left in place. For instance, it is not uncommon for the frieze board 22 to be removed from the structure before the vinyl siding is put in place. Similarly, the soffit 26 may be removed if, as may be the instance in an older structure, the soffit 26 is no longer structurally sound. Similarly, application of vinyl siding to new construction may be done with or without the inclusion of a suitable soffit 26.

With reference now to FIG. 2, therein is illustrated the cornice 10 as shown in FIG. 1, to which extruded vinyl soffit and fascia panel siding has been applied in a conventional fashion. In such an application, certain considerations must be made so that the vinyl panels affixed thereto will have an attractive appearance and will be suitably durable.

For instance, unlike other types of siding materials, vinyl siding may crack or split when nails are inserted directly through it. In view of this, vinyl siding is usually provided with elongated nailing slots for affixing the panels to a structure. Additionally, these nailing slots accommodate expansion and contraction of the vinyl panels when they are subjected to changes in temperature. Corrosion resistant nails are typically used.

Another consideration in the application of vinyl siding is that the panels should be arranged so that the nails and nailing slots are covered by associated panel or trim pieces. In this way, the vinyl siding surface exhibits desirable moisture resistant qualities and also assures that the final finish of the siding is attractive and clean.

Keeping in mind the above considerations, the typical soffit and fascia vinyl siding construction shown in FIG. 2 includes soffit panels 30 (one being shown) along the bottom of the cornice 10, and a fascia panel 32 disposed adjacent to the fascia 28 along the outer surface of the cornice 10.

Application of soffit panels of this type is effected by affixing an inner channel 34 to the lower side of the cornice 10 adjacent to frieze board 22 of the wall of the structure. Nails 35 extend through suitable nailing slots provided in the inner channel 34 and into the soffit 26 of the cornice 10. The inner channel 34 is generally J-shaped in cross-section, and is adapted to receive therein inner edge portions of the soffit panels 30.

The typical installation illustrated in FIG. 2 further includes the application of an elongated cover trim 36 which is affixed by suitable nails 38 along the top of the fascia 28 of the cornice 10. The cover trim 36 is a generally J-shaped channel and includes an inwardly extending lock tab. The locking tab is designed to cooperate with suitable punched-in lock lugs which project outwardly from the surface of an associated vinyl panel member.

A typical construction is illustrated in FIGS. 5 and 5*a*, showing cover trim 37 including a lock tab 40, and lock lugs 76 in a panel 74. The lock lugs are formed along edges of vinyl panels by a suitable punching tool, and are frequently used in a wide variety of instances for the installation of all types of a vinyl siding.

With further reference to FIG. 2, the typical soffit and fascia siding installation also includes the application of the fascia panel 32 to the cornice 10. The fascia panel 32 is provided with punched-in lock lugs along its upper edge portion, as described, so that the fascia panel 32 is suitably fitted within and interlocked with the cover trim 36. Fascia panel 32 may be typically formed to include a lower portion which fits about the lower corner of the fascia 28, and further includes an inwardly opening generally F-shaped channel 44.

After the fascia panel 32 has been inserted and locked into the cover trim 36, the panel 32 is further secured to the cornice 10 by the insertion of nails 45 through suitable nailing slots provided in the channel 44. It will be noted that at this point during a typical installation, the lower side of the cornice 10 has been provided with a pair of oppositely opening channels (34 and 44) respectively disposed adjacent to the wall of the structure and the fascia 28 of the cornice. The typical installation is now completed by the insertion of soffit panels 30 within the respective channels 34 and 44.

FIG. 3*a* illustrates in cross-section a typical soffit panel 30 interlocked with an adjacent soffit panel. These panels are typically fabricated in elongated pieces which are cut to the required installation size at the job site. Each of the soffit panels 30 defines along one edge an inwardly extending lock lip 47. The other edge of the soffit panel 30 is shaped so as to define a lock groove 46 which is adapted to receive and interlock with the lock lip 47 of an adjacent panel.

Each soffit panel 30 is formed to further define nailing slots 48, typically disposed adjacent to the lock groove 46, for insertion of nails 50 therethrough for affixing each soffit panel 30 in place along the lower side of cornice 10. In some cornice constructions it may be desirable to provide ventilation therein, so some or all of the soffit panels 30 may include suitable ventilation holes 52 extending therethrough.

In the typical soffit and fascia panel installation illustrated in FIG. 2, the application and installation of the soffit panels 30 has customarily presented a time-consuming and difficult job. In order to place each of the soffit panels 30 in position beneath the cornice 10, such that the inner and outer edge portions thereof are respectively disposed within the channels 34, 44, each of the panels 30 is inserted into the channels 34, 44 at the ends thereof.

Each of the soffit panels 30 is then slid along the channels into position, and nails 50 inserted through the nailing slot 48 provided therein. After this has been done, the next soffit panel 30 is again slid from the ends of the channels 34 and 44 into position, and its lock lip 47 interlocked with the lock groove 46 defined by the previously installed panel. This panel is then suitably nailed to the cornice 10 and this procedure repeated until all of the soffit panels 30 are in position and affixed to the lower side of the cornice 10.

It will be appreciated that this procedure and arrangement provides a vinyl soffit and fascia panel construction for the cornice of a structure which has a finished appearance and in which all of the fastening nails are covered by associated vinyl members. However, it is clear that this procedure is extremely time-consuming, particularly in view of the fact that a person applying these panels would usually be working on a ladder or scaffold, possibly at a substantial height.

In view of the difficulty and time required in installing the soffit panels 30 in the above-described fashion, it is sometimes attempted by the person installing the panels to flex or bend each of the soffit panels 30 so that each of the inner and outer edge portions thereof may be fitted within the respective channels 34 and 44 while the panel 30 is being maintained in a flexed condition by the person inserting it. This method of installing soffit panels is no significant improvement over the above-described procedure, particularly since the formation of each of the soffit panels 30 with lock lips 47 and lock grooves 46 acts to rigidify the panels with respect to the axis about which they must be flexed for insertion. Thus, although the typical soffit and fascia panel installation shown in FIG. 2 provides the desired appearance and fit for the cornice 10, the attendant problems of installation of the soffit panels 30 have made this type of installation difficult and labor intensive.

A vastly improved arrangement and method for the application of extruded vinyl soffit and fascia siding panels to a cornice, in accordance with the subject invention, is illustrated in FIG. 3. It will be observed that the application of the soffit and fascia panels of the subject invention are shown in conjunction with a cornice 10 as illustrated in FIG. 1, but it will be understood that the use of this type of an installation and construction is highly adaptable to a wide variety of cornice configurations.

In the preferred embodiment of the invention that is illustrated in FIG. 3, installation is started by the application of an inner channel 31 of the type illustrated in FIG. 2 (channel 34). The inner channel 31, which is of a typical J-shaped configuration, is attached to the lower side of the cornice 10 by insertion of suitable nails 29 through the nailing slots 33 provided therein. Similarly, an elongated cover trim portion 37, which is also a generally J-shaped channel, is attached to the top of the fascia 28 by use of nails 41 through the nailing slots 39 provided therein. Cover trim 37 includes an inwardly extending lock tab 40 which is adapted to cooperate with upstanding lock lugs 76 suitably punched-in to the edge portion of the associated fascia panel (see FIGS. 5 and 5*a*).

As shown in FIGS. 3 and 4, the novel construction of the subject invention now provides for the installation of soffit panels 30, as described above and illustrated in FIG. 3*a*, along the lower side of the cornice 10. Significantly, the subject arrangement no longer requires that each of the soffit panels 30 must be slid from the ends of supporting channels, or individually flexed for fitment therein, but provides for the application of the soffit panels 30 in a simple and straightforward manner.

The inner edge portion of each of the soffit panels 30 is merely inserted into the opening defined by the J-shaped channel 31, and easily nailed into place by the insertion of nails through the nailing slots 48 provided therein. The inner edge portion of the next to be installed soffit panel 30 may then be easily inserted into the channel 31 and its lock lip 47 interengaged with the lock groove 46 defined by the previously installed panel. This panel may then be nailed into place as described, and this process repeated until all of the soffit plates 30 are in position along the lower side of cornice 10. Thus the soffit panels 30 have been efficiently affixed to the lower surface of the cornice 10.

With further reference to FIGS. 3 and 4, and reference now to FIG. 5, the subject invention provides a novel corner member 54 for application along the lower edge of the fascia 28. The elongated corner member 54 comprises a generally vertically extending outer leg 56 and a generally horizontal lower leg 58. The lower leg 58 is formed integrally with the outer leg 56, and extends inwardly of the cornice 10 from the bottom of the outer leg 56.

The corner member 54 further includes an integrally formed lock leg 60, which depends from the lower surface of the lower leg 58 intermediate the inner edge thereof and the bottom of the outer leg 56, and defines with the lower leg 58 an outwardly opening lock slot 62. The lock leg 60 includes at its distal end portion a lock tab 64. The outer leg 56 includes at the top and bottom portions thereof outwardly extending spacing lugs 66 and 68. A similar spacing lug 70 is provided at the inner edge portion of the lower leg 58 in upstanding relation thereto.

The corner member 54 is attached to the fascia 28 of the cornice 10 by insertion of nails 75 through the nailing slots 72 in upper leg 56. As the corner member 54 is fitted to the bottom of the fascia 28, it will be seen that the upstanding spacing lug 70 provided on the lower leg 58 abuts and engages the lower surfaces of the soffit panels 30 and thus provides a neat and finished appearance for the bottom of the cornice 10.

The installation is completed by the attachment of a fascia panel 74, generally L-shaped in cross-section, to the cover trim 36 and the corner member 54. The fascia panel 74 includes punched-in lock lugs 76 along the upper edge thereof for insertion in and engagement with the cover trim 37 as earlier described, and shown in FIG. 5*a*. The fascia panel 74 further includes an inwardly extending lower edge portion 78 which includes punched-in lock lugs 80. Installation of the fascia panel 74 is a simple matter of inserting its upper edge portion into the cover trim 37 so that the lock lugs 76 interlock therewith, and then inserting the lower edge portion 78 into the lock slot 62 defined by the corner member 54 such that the lock lugs 80 lockingly engage and interlock with the lock tab 64 on the lock leg 60 of the corner member 54 for retaining the edge portion 78 therein. The installation of the soffit and fascia panels of the subject invention is now complete, providing an attractive finished appearance for the cornice, with all attaching nails covered by associated vinyl members, and with a minimum of labor and difficulty.

DESCRIPTION OF ALTERNATE EMBODIMENTS

With reference now to FIG. 6, therein is illustrated a first alternate embodiment of the subject invention. As illustrated, the alternate soffit and fascia siding arrangement includes an inner soffit panel channel 110 which is affixed beneath the cornice 10 adjacent to the wall of the structure by suitable nails 112 which extend through suitable nailing slots provided in the inner channel 110. Cover trim 114, which is a channel generally J-shaped in cross-section, is attached to the top of the fascia 28 by nails 116 which extend through nailing slots provided therein. With inner channel 110 and the cover trim 114 in place, fascia panel 118 may now be applied to the cornice 10. The upper portion of fascia panel 118 is inserted into the slot defined by the cover trim 114. The fascia panel 118 is punched along its upper edge portion to include lock lugs which engage and interlock with corresponding lock tabs provided on the cover trim 114. Although not illustrated in FIG. 6, this detail of the construction is comparably shown in FIGS. 5 and 5*a* in conjunction with the presently preferred embodiment of the invention.

With reference again to FIG. 6, after fascia panel 118 has been fitted within the cover trim 114, corner member 124 may be affixed to the cornice 10 adjacent the bottom of fascia 28. In this embodiment, the corner member 124 is of generally elongated configuration, and includes a generally vertically disposed outer leg 126 and a lower leg 128 extending inwardly of the cornice from a bottom portion of the outer leg 126. In order that the corner member 124 may be properly fitted about fascia 28, the lower leg 128 may include an offset flange portion 130 provided with elongated nailing slots through which nails 132 extend. It will be appreciated that the exact configuration of corner member 124 would be somewhat dependent upon the manner in which fascia 28 and soffit 26 of the cornice 10 are fitted together.

The corner member 124 further includes a depending lock leg 134 formed integrally with and extending downwardly from a portion of the outer leg 126 intermediate the upper edge and bottom thereof, and defines therewith a downwardly opening lock slot. After fascia panel 118 has been fitted within the cover trim 114, the corner member 124 is affixed to the cornice 10 with nails 132 such that outer leg 126 overlaps and engages a lower edge portion of the fascia panel 118, thus maintaining the fascia panel 118 in its proper position. After this has been accomplished, the construction may be completed by affixing soffit panel 122 to the cornice. In this embodiment of the subject invention, soffit panel 120 is of generally planar configuration, and includes an upwardly extending lock angle portion 122 at the outer edge thereof. The inner edge of the soffit panel 120 is fitted within the recess defined by the inner channel 110. If desired, soffit panel 120 and inner channel 110 may respectively include lock lugs and a lock tab for interlockingly engaging each other. After the inner edge portion of soffit panel 120 has been fitted into the inner channel 110, it is now a simple matter for the soffit panel 120 to be swung upwardly so that lock angle portion 122 may be inserted within the slot defined by lock leg 134 of the corner member 124. So that the soffit panel 120 is retained in position by the corner member 124, the angle portion 122 is provided with punched-in lock lugs 123, as previously described, which are adapted to interlock and engage with a lock tab 135 provided on the lock leg 134. Once the lock angle portion 122 of the soffit panel 120 has been fitted within the slot defined by outer leg 126 and lock leg 124, the installation of the soffit and fascia siding construction is complete. It will be appreciated that this arrangement provides a neat and finished appearance for the cornice 10 of the structure in a very straightforward fashion.

With reference now to FIG. 7, therein is illustrated a further alternate embodiment of the subject invention. In this arrangement, an elongated inner soffit panel channel 140, of generally J-shape in cross-section, is affixed beneath the cornice 10 adjacent to the wall of the structure by nails 142 extending through elongated nailing slots provided therein. Elongated cover trim 144, which is a generally J-shaped channel, is affixed along the top of the fascia 118 by nails 146 extending therethrough. A soffit panel 148 may now be applied to the cornice 10 by insertion of the inner edge portion of the soffit panel 148 within the recess defined by inner channel 140. Engaging and interlocking lock lugs and lock tabs may be respectively provided on the soffit panel 148 and the inner channel 140 to insure that soffit panel 148 is retained in position.

Elongated corner member 154 is now applied adjacent the bottom of fascia 28 and is affixed thereto by nails 155. The corner member 154 includes an outer leg 156, and a lower leg 158 formed integrally with the outer leg 156 and extending inwardly from the bottom portion thereof. The corner member 154 further includes a depending lock leg 160 formed integrally with the outer leg 156 and depending from a portion thereof intermediate its upper edge and bottom portions to define a downwardly opening lock slot with the outer leg 156.

The fascia panel 150 may now be applied and securely interlocked with the other elements of the construction. The fascia panel 150 is of generally J-shape in cross-section, and includes an upturned portion forming a lock flange 152 at the lower portion thereof. In order to apply the fascia panel 150 to the cornice 10, the upper edge of the panel 150 is inserted into cover trim 144. The cover trim 144 and the fascia panel 150 are respectively provided with a lock tab 162 and punched-in lock lugs 164 (see similar construction in FIGS. 5 and 5*a*) which interlock and engage each other so that the panel 150 is retained within the cover trim 144. As the upper edge of the panel 150 is fitted within the cover trim 154, locking flange 152 provided along the lower portion of the panel 150 is concurrently fit within the lock slot defined by lock leg 160 and outer leg 156 of the corner member 154. The lock leg 160 is provided with lock tab 166 which is adapted to engage and interlock with lock lugs 168 provided on the lock flange 152 of the fascia panel 150 so that the flange 152 is retained within the lock slot. Once fascia panel 150 has been inserted into and interlocked with cover trim 144 and corner member 154, the soffit and fascia siding construction is complete, with this embodiment of the subject invention again providing a soffit and fascia panel vinyl siding construction which may be applied in a straightforward fashion and results in a neat and finished appearance for the cornice of the structure.

From the foregoing, it will be observed that numerous variation and modifications may be effected without departing from the true spirit and scope of the novel concept of the subject invention. It will be understood that no limitation with respect to the specific constructions illustrated herein is intended or should be inferred. It is, of course, intended to cover by the appended claims all such modifications as fall within the scope of the claims.

What is claimed is:

1. An improved siding construction for covering a soffit and a fascia of a cornice located beneath a portion of a roof immediately adjacent the upper end of said fascia and projecting outwardly of a wall of a structure immediately adjacent the inner end of said soffit comprising:

a pair of panels including a soffit panel adapted to be affixed beneath said soffit and including an inner edge portion and an outer free edge portion, and a fascia panel adapted to be affixed to said fascia and including an upper edge portion and a lower free edge portion;

a first inner channel adapted to be affixed to said structure immediately adjacent to the inner end of said soffit and the wall, opening away from said wall, for receiving the inner edge portion of said soffit panel therein;

a second upper channel adapted to be affixed to said structure immediately adjacent to the upper end of the fascia and the roof portion, opening away from said roof portion, for receiving said upper edge portion of said fascia panel therein; and a corner member including a generally vertically disposed outer leg having an upper first edge portion and a bottom portion, and a lower leg integral with said bottom portion and defining a corner therewith and extending therefrom generally inwardly of said cornice and including an inner second edge portion, and a lock leg depending from one of said legs intermediate of said first and second edge portions and said corner;

said lock leg defining a lock slot with one of said outer and lower legs, said corner member being adapted to be affixed to said cornice adjacent the junction of said fascia and said soffit for engaging and retaining in place the free edge portion of one of said panels, said lock slot adapted to interlock with and lockingly retain therein the free edge portion of the other said panels.

2. The improved siding construction of claim 1, wherein said lock leg depends from said lower leg and the lock slot defined therewith is outwardly opening and adapted to lockingly retain said lower edge portion of said fascia panel.

3. The improved siding construction of claim 2, wherein said outer leg defines nailing slots for insertion of nails therethrough for affixing said corner member to said fascia whereby said nails are covered when said fascia panel is affixed to said fascia.

4. The improved siding construction of claim 2, wherein said outer leg includes at least one outwardly extending spacing leg for engaging said fascia panel when said upper edge portion of said fascia panel is received by said second channel and said lower edge portion is retained within said lock slot.

5. The improved siding construction of claim 1, wherein said lower leg is adapted to abut and overlap the outer edge portion of said soffit panel having its inner edge portion inserted within said first inner channel.

6. The improved siding construction of claim 1, wherein said lock leg depends from said outer leg of said corner member and said lock slot opens downwardly, and said soffit panel includes an upstanding lock angle at the outer edge portion thereof adapted to be lockingly retained within said lock slot.

7. The improved siding construction of claim 6, wherein said lower leg includes an offset flange portion defining nailing slots for insertion of nails therethrough for affixing said corner member to said soffit whereby the nails are adapted to be covered by said soffit panel.

8. The improved siding construction of claim 6, wherein said outer leg of said corner member is adapted to engage and overlap the lower edge of said fascia panel after the upper edge of said fascia panel is received by said second channel and when said corner member is affixed to said cornice, thereby accommodating insertion of said lock angle within said lock slot thereafter.

9. The improved siding construction of claim 1, wherein said lock leg depends from said outer leg and said lock slot opens downwardly, and said lower edge of said fascia panel includes an upturned flange adapted to be inserted and retained within said lock slot.

10. The improved siding construction of claim 9, wherein said lower leg of said corner member abuts and overlaps the lower surface of said outer edge portion of said soffit panel, and said outer leg defines nailing slots for the insertion of nails therethrough for affixing said corner member to said fascia thereby accommodating affixing said corner member to said fascia after the inner edge portion of said soffit panel is received by said first inner channel and before said upturned flange is inserted in said lock slot.

11. An improved siding construction for covering a cornice located beneath a portion of a roof projecting outwardly of a wall of a structure, said construction including:

a soffit panel having an inner edge portion and an outer free edge portion, adapted to be affixed beneath the lower surface of said cornice immediately adjacent said wall, and a fascia panel having an upper edge portion and a lower free edge portion, adapted to be affixed to an outwardly facing surface of said cornice immediately adjacent said roof portion;

a first inner channel adapted to be affixed to said structure immediately adjacent to the inner end of the lower surface of said cornice and the wall, opening away from said wall, for receiving the inner edge portion of said soffit panel therein;

a second upper channel adapted to be affixed to said structure immediately adjacent to the upper end of the outwardly facing surface of said cornice and the roof portion, opening away from said roof portion, for receiving said upper edge portion of said fascia panel therein; and an elongated corner member adapted to be affixed to said cornice having a generally L-shaped configuration including a generally vertically extending outer leg and a lower leg having an inner edge portion extending inwardly of the cornice from the outer leg and formed integrally therewith;

said corner member further including a lock leg depending from the lower surface of said lower leg intermediate the bottom of said outer leg and said inner edge portion and defining with said lower leg an outwardly opening lock slot adapted to lockingly receive and retain an inwardly extending lower edge portion of said fascia panel therein, thereby accommodating affixing of said corner member to said cornice after said soffit panel has been affixed beneath said cornice.

12. The improved siding corner construction of claim 11, said outer leg defining nailing slots for insertion of nails therethrough for affixing said corner member to said cornice, said fascia panel being adapted to cover said nailing slots.

13. The improved siding corner construction of claim 11, said lower leg including an upstanding lug along the inner edge portion thereof adapted to abut said soffit panel when said corner member is affixed to said cornice.

14. The improved siding corner construction of claim 11, said outer leg including at least one upstanding lug for engaging said fascia panel when said lower edge portion is lockingly retained within said lock slot.

15. The improved siding corner construction of claim 11, wherein said lock leg includes an upstanding lock tab, and said inwardly extending lower edge portion including at least one lock lug adopted to be lockingly engaged by said lock tab when said lower edge portion is retained within said lock slot.

16. An improved method of assembling soffit and fascia siding for a cornice having a fascia surface located beneath a portion of a roof immediately adjacent thereto and a soffit surface immediately adjacent and projecting outwardly of a wall of a structure comprising the steps of:

affixing a first inner channel to said structure immediately adjacent to the inner end of said soffit surface and said wall with the channel opening outwardly from said wall;

affixing a second upper channel immediately adjacent to the upper end of said fascia surface and the roof portion with the channel opening downwardly away from said roof portion;

inserting an inner edge of a soffit panel within said first inner channel;

affixing said soffit panel to said soffit surface of said cornice;

affixing an elongated corner member adjacent the junction of said fascia surface and said soffit surface, said corner member including a vertically extending outer leg, a lower leg having an inner edge portion and extending inwardly of said cornice from the outer leg, and a lock leg depending from the lower surface of said lower leg intermediate the bottom of said outer leg and said inner edge portion and defining with said lower leg an outwardly opening lock slot, said lower leg overlapping and retaining in place the lower surface of an outer edge portion of said soffit soft panel; and affixing a fascia panel having an inwardly extending lower edge portion to said cornice by inserting an upper edge portion of said fascia panel into said second upper channel and inserting said lower edge portion into said lock slot.

17. The improved method of assembling soffit and fascia siding as recited in claim 16, wherein said lock leg includes lock means for lockingly retaining said lower edge portion within said lock slot, and including the step of inserting said lower edge portion of said fascia panel into said lock slot to engage and interact with said lock means.

* * * * *